US009718484B2

(12) United States Patent
Zanutti

(10) Patent No.: US 9,718,484 B2
(45) Date of Patent: Aug. 1, 2017

(54) RUNNING GEAR UNIT FOR A RAIL VEHICLE

(71) Applicant: Bombardier Transportation GmbH, Berlin (DE)

(72) Inventor: Cedric Zanutti, Sart-Eustache (BE)

(73) Assignee: Bombardier Transportation GmbH, Berlin (DE)

( * ) Notice: Subject to any disclaimer, the term of this patent is extended or adjusted under 35 U.S.C. 154(b) by 127 days.

(21) Appl. No.: 14/402,904

(22) PCT Filed: May 29, 2013

(86) PCT No.: PCT/EP2013/061132
§ 371 (c)(1),
(2) Date: Nov. 21, 2014

(87) PCT Pub. No.: WO2013/178716
PCT Pub. Date: Dec. 5, 2013

(65) Prior Publication Data

US 2015/0107487 A1 Apr. 23, 2015

(30) Foreign Application Priority Data

May 30, 2012 (EP) ..... 12170076

(51) Int. Cl.
*B61F 5/30* (2006.01)
*B61F 5/32* (2006.01)
*B61F 5/52* (2006.01)

(52) U.S. Cl.
CPC ..... *B61F 5/30* (2013.01); *B61F 5/325* (2013.01); *B61F 5/52* (2013.01)

(58) Field of Classification Search
CPC ..... B61F 3/00; B61F 3/02; B61F 3/04; B61F 3/12; B61F 3/16; B61F 5/00; B61F 5/02;
(Continued)

(56) References Cited

U.S. PATENT DOCUMENTS 5,415,107 A 5/1995 Tutzauer
2005/0116436 A1 6/2005 Landrot
(Continued)

FOREIGN PATENT DOCUMENTS

CN 2515076 Y 10/2002
CN 202413825 U 9/2012
(Continued)

*Primary Examiner* — R. J. McCarry, Jr.
(74) *Attorney, Agent, or Firm* — The Webb Law Firm

(57) ABSTRACT

A running gear unit for a rail vehicle, having a running gear frame body. The frame body includes two longitudinal beams and a transverse beam unit providing a structural connection between the longitudinal beams, such that a substantially H-shaped configuration is formed. Each longitudinal beam has a suspension interface section associated to a free end section of the longitudinal beam and forming a primary suspension interface for a primary suspension device. Each longitudinal beam has a pivot interface section associated to the primary suspension interface section and forming a pivot interface for a pivot arm. The primary suspension interface is configured to take a total resultant support force acting in the area of the free end section when the frame body is supported on the associated wheel unit.

18 Claims, 3 Drawing Sheets

(58) Field of Classification Search
CPC ..... B61F 5/04; B61F 5/08; B61F 5/10; B61F 5/12; B61F 5/14; B61F 5/16; B61F 5/22; B61F 5/26; B61F 5/30; B61F 5/36
See application file for complete search history.

(56) References Cited

U.S. PATENT DOCUMENTS

| | | | |
|---|---|---|---|
| 2010/0011985 | A1 | 1/2010 | Bieker et al. |
| 2010/0107923 | A1 | 5/2010 | Rodet et al. |
| 2010/0307371 | A1 | 12/2010 | Rodet |
| 2011/0248433 | A1 | 10/2011 | Diemling et al. |

FOREIGN PATENT DOCUMENTS

| | | | | | |
|---|---|---|---|---|---|
| DE | 4136926 | A1 | | 5/1993 | |
| DE | 4214066 | A1 | | 11/1993 | |
| DE | 4428038 | | * | 8/1995 | ..... B61F 3/16 |
| DE | 4428038 | C1 | | 8/1995 | |
| DE | 102011110090 | A1 | | 2/2013 | |
| EP | 0326179 | A1 | | 8/1989 | |
| EP | 1538056 | A1 | | 6/2005 | |
| EP | 2258597 | A1 | | 12/2010 | |
| FR | 2914610 | A1 | | 10/2008 | |
| RU | 2010109393 | A | | 9/2011 | |
| WO | 2010072428 | A1 | | 7/2010 | |

* cited by examiner

RUNNING GEAR UNIT FOR A RAIL VEHICLE

CROSS-REFERENCE TO RELATED APPLICATIONS

This application is the U.S. national phase of International Application No. PCT/EP2013/061132 filed May 29, 2013, and claims priority to European Patent Application No. 12170076.9 filed May 30, 2012, the disclosures of which are hereby incorporated in their entirety by reference.

BACKGROUND OF THE INVENTION

Field of the Invention

The present invention relates to a running gear unit for a rail vehicle comprising a running gear frame body defining a longitudinal direction, a transverse direction and a height direction. The frame body comprises two longitudinal beams and a transverse beam unit providing a structural connection between the longitudinal beams in the transverse direction, such that a substantially H-shaped configuration is formed. Each longitudinal beam has a primary suspension interface section associated to a free end section of the longitudinal beam and forming a primary suspension interface for a primary suspension device connected to an associated wheel unit. Furthermore, each longitudinal beam has a pivot interface section associated to the primary suspension interface section and forming a pivot interface for a pivot arm connected to the associated wheel unit. The primary suspension interface is configured to take a total resultant support force acting in the area of the free end section when the frame body is supported on the associated wheel unit. The invention furthermore relates to a rail vehicle unit with a running gear unit according to the invention.

Description of Related Art

Such a running gear frame is, for example, known from DE 41 36 926 A1 (the entire disclosure of which is incorporated herein by reference). This running gear frame, due to its specific design of the support on the wheel units (such as wheel pairs or wheels sets etc.) is particularly well suited for the use in low floor vehicles, such as tramways or the like. However, due to this support using a horizontally arranged primary spring resting against a pillar element which is considerably retracted in the longitudinal direction with respect to the pivot interface, the running gear frame has a very complex, multiply branched geometry. Hence, just like for many other structural components for rail vehicles, the production of the running gear frame known from DE 41 36 926 A1, not least due to its comparatively complex geometry, is performed by welding sheet material. This production method, however, has the disadvantage that it requires a relatively large percentage of manual labor, which makes the production of running gear frames comparatively expensive.

Furthermore, on the one hand, the pillar element and the horizontally arranged primary spring require comparatively much building space. Since, typically, the building space budget available in a running gear (for receiving the plurality of components required in modern rail vehicles) is heavily restricted, such a configuration is less favorable. This is not least due to the fact that more effort has to be taken to fit all the necessary components into the limited building space available which, ultimately, adds to the overall cost of the vehicle. In addition, the pivot arm itself is of comparatively complex and heavy design, thereby also adding to the overall complexity, the weight and, ultimately, to the overall cost of the vehicle.

SUMMARY OF THE INVENTION

Thus, it is the object of the present invention to provide a running gear unit as described above, which does not show the disadvantages described above, or at least shows them to a lesser extent, and which, in particular, provides a space saving design which reduces the overall effort and facilitates simple production of such running gear units.

The above objects are achieved starting from a running gear unit according to the preamble of claim 1 by the features of the characterizing part of claim 1.

The present invention is based on the technical teaching that a more space saving design resulting in a more simple producibility can be accomplished, if the primary suspension interface is configured such that the total resultant support force acting in the area of the respective free end (i.e. the total force resulting from all the support forces acting via the primary suspension in the region the free end, when the running gear frame is supported on the wheel unit) is inclined with respect to the longitudinal direction and inclined with respect to the height direction.

It should be noted that, unless stated otherwise in the following, all statements with respect to inclination of the total resultant force refer to a static state with a rail vehicle standing on a straight level track under its nominal load.

Such an inclination of the total resultant support force with respect to both the longitudinal direction and the height direction, in particular, allows realization of very beneficial configurations in terms of the required building space. In particular, compared to a configuration as known from DE 41 36 926 A1, such an arrangement allows the primary suspension device to move closer to the wheel unit, more precisely closer to the axis of rotation of the wheel unit. This has not only the advantage that the primary suspension interface also can be arranged more closely to the wheel unit, which clearly saves space in the central part of the running gear. Furthermore, in particular, the pivot arm connected to the wheel unit can be of smaller, more lightweight and less complex design.

Furthermore, for example, such an inclined total resultant support force yields the possibility to realize a connection between the pivot arm and the frame body at the pivot interface which is both self adjusting under load (due to the components of the total resultant force acting in the longitudinal direction and the height direction) while being easily dismounted in absence of the support load as it is described in greater detail in pending German patent application No. 10 2011 110 090.7 (the entire disclosure of which is incorporated herein by reference).

Finally, such a design has the advantage that, not least due to the fact that the interface section moves closer to the wheel unit, it facilitates a switch to a more cost-effective automated production of the frame body using an automated casting process as will be explained in further detail below.

Hence, according to one aspect, the present invention relates to a running gear unit for a rail vehicle, comprising a running gear frame body defining a longitudinal direction, a transverse direction and a height direction. The frame body comprises two longitudinal beams and a transverse beam unit providing a structural connection between said longitudinal beams in said transverse direction, such that a substantially H-shaped configuration is formed. Each longitudinal beam has a suspension interface section associated to a free end section of said longitudinal beam and forming a primary suspension interface for a primary suspension device connected to an associated wheel unit. Each longitudinal beam has a pivot interface section associated to the primary suspension interface section and forming a pivot interface for a pivot arm connected to the associated wheel unit. The primary suspension interface is configured to take a total resultant support force acting in the area of the free end section when the frame body is supported on the associated wheel unit. The primary suspension interface is configured such that the total resultant support force is inclined with respect to the longitudinal direction and inclined with respect to the height direction.

Basically, the total resultant support force may have any desired and suitable inclination with respect to the longitudinal direction and the height direction. Preferably, the total resultant support force is inclined with respect to said height direction by a primary suspension angle, the primary suspension angle ranging from 20° to 80°, preferably from 30° to 70°, more preferably from 40° to 50°, since these values, among others, are particularly beneficial in terms of a space-saving design as well as a favorable introduction of support loads from the wheel unit via the primary suspension into the frame body.

Generally, any desired relation between the total resultant force and the wheel unit, in particular its axis of wheel rotation, may be chosen. Preferably, the associated wheel unit is connected to the frame body via the pivot arm pivotably linked to the pivot interface. The primary suspension interface and the primary suspension device are arranged such that the total resultant support force intersects a wheel shaft of the wheel unit, in particular, an axis of wheel rotation of said wheel shaft. Such a configuration, among others, results in a particularly beneficial introduction of support loads from the wheel unit into the primary suspension and onwards into the frame body.

The primary suspension interface may have any desired shape. For example, one or more separate interface surfaces may be realized. These interface surfaces may furthermore have any desired shape, for example, a section wise planar shape, a section wise curved shape as well as a section wise stepped shape etc.

With advantageous embodiments of the invention, the primary suspension interface defines a main interface plane, the main interface plane being configured to take at least a major fraction of the total resultant support force. The main interface plane is inclined with respect to the longitudinal direction and inclined with respect to the height direction. Preferably, the main interface plane is inclined with respect to the height direction by a main interface plane angle, the main interface plane angle ranging from 20° to 80°, preferably from 30° to 70°, more preferably from 40° to 50°. Furthermore, preferably, the main interface plane is substantially parallel with respect to the transverse direction which leads to a configuration which is very simple to manufacture and leads to an advantageous introduction of the forces into the frame body.

Basically, any desired and suitable relative position may be selected between the primary suspension interface and the pivot interface. However, preferably, the pivot interface section, in the longitudinal direction, is arranged to be at least partially retracted behind a center of the primary suspension interface, which results in a very simple design of the end part of the longitudinal beam as a pillar section. This is beneficial under many manufacturing aspects, in particular, the suitability of the frame body for using an automated casting process. Furthermore, such a configuration is beneficial in terms of the design of the pivot arm and the introduction of the support loads into the frame body.

Typically, a center of a forward primary suspension interface and a center of a rearward primary suspension interface of one of the longitudinal beams, in the longitudinal direction, define a maximum primary suspension interface center distance. Furthermore, typically, a forward pivot interface section is associated to the forward primary suspension interface and defines a forward pivot axis for a forward pivot arm, while a rearward pivot interface section is associated to the rearward primary suspension interface and defines a rearward pivot axis for a rearward pivot arm, the forward pivot axis and the rearward pivot axis, in the longitudinal direction, defining a pivot axis distance. Preferably, the pivot axis distance is 60% to 105%, preferably 70% to 95%, more preferably 80% to 85%, of the maximum primary suspension interface center distance. Such a configuration is particularly beneficial in terms of the design of the pivot arm and the introduction of the support loads into the frame body.

Basically, the primary suspension unit and, consequently, the primary suspension interface in may have any desired and suitable shape. For example, any desired type and/or number of primary spring elements may be used in connection with an appropriate interface. With certain preferred embodiments of the invention having a very simple design, the primary suspension interface is configured as an interface for a single primary suspension device. Preferably, the primary suspension device is formed by a single primary suspension unit, which, further preferably, is formed by a single primary suspension spring, leading to a design which is very simple and easy to manufacture. Any type of primary spring may be used. Preferably, due to its compact and robust design, a rubber-metal-spring unit is used for the primary spring.

The frame body, in general, may be produced in any desired manufacturing process. However, as mentioned above, the design of the interface section with an inclined total resulting support force and the closer proximity between the interface section and the wheel unit allows a switch to a more cost-effective automated production of the frame body using an automated casting process. This is not least a result of the fact that, which such a shift of the end part of the longitudinal beam closer towards the wheel unit, this end part may be of less branched and, hence, less complex design (compared to the solution known from DE 41 36 926 A1), which is now suitable for such an automated casting process.

Hence, with preferred embodiments of the invention, the frame body is formed as a monolithically cast component made of a grey cast iron material. Using grey cast iron has the advantage that it comprises a particularly good flow capability during casting due to its high carbon content and thus leads to a very high level of process reliability. It has turned out that, due to one or more of the geometric modifications as outlined herein, a switch to grey cast iron was feasible allowing the production of such a comparatively large frame body of complex, generally three-dimensional geometry in conventional molding boxes of automated casting production lines. Consequently, production of the frame body is significantly simplified and rendered more cost effective. In fact, it has turned out that, compared to a conventional welded running gear frame, a cost reduction by more than 50% may be achieved with such an automated casting process.

A further advantage of the grey cast iron material is its improved damping property compared to the steel material which is typically used. This is particularly advantageous with respect to reducing the transmission of vibrations into the passenger compartment of a rail vehicle.

The grey cast iron material can be any suitable grey cast iron material. Preferably, it is a so called nodular graphite iron cast material or spheroidal graphite iron (SGI) cast material. So called austempered ductile iron (ADI) cast material may also be used. Hence. EN-GJS materials as currently specified in European Norms EN 1563 (for SGI materials) and EN 1564 (for ADI materials) may be used. Particularly suitable materials are EN-GJS-400 materials (as specified in European Norm EN 1563), which provide a good compromise between strength, elongation at fracture and toughness. Preferably, EN-GJS-400-18U LT is used, which is characterized by advantageous toughness at low temperatures. Another preferred material would be EN-GJS-350-22-LT.

With further preferred embodiments of the invention providing a comparatively simple structure of the frame body well-suited for an automated casting process, each longitudinal beam has an angled section associated to the free end section, the angled section being arranged such that the free end section forms a pillar section at least mainly extending in the height direction. Furthermore, preferably, the pivot interface section is integrated into the angled section. Integration of the pivot interface section into the angled section also provides a noticeable reduction in the complexity of the frame geometry which facilitates using a grey cast iron material for forming the frame body as a monolithically cast component (i.e. forming the frame body in a single cast piece) in an automated casting process.

Integration of the pivot interface section into the angled section may be achieved by any suitable geometry avoiding a split of the structure in separate branches (as it is known from the prior art structures), which the material flow would have to follow during casting. Preferably, the pivot interface section, in the longitudinal direction, is arranged to be at least partially retracted behind the associated free end section, thereby here simple manner achieving such an integration of the pivot interface section into the angled section.

With typical variants of the invention, a forward free end section and a rearward free end section of one of the longitudinal beams, in the longitudinal direction, define a maximum longitudinal beam length of the longitudinal beam. Furthermore, typically, a forward pivot interface section is associated to the forward free end section and a rearward pivot interface section is associated to the rearward free end section, the forward pivot interface section and the rearward pivot interface section, in the longitudinal direction, defining a maximum pivot interface dimension of the longitudinal beam. Preferably, the maximum pivot interface dimension is 70% to 110%, preferably 80% to 105%, more preferably 90% to 95%, of the maximum longitudinal beam length, thereby achieving a very compact design showing (if at all) only a comparatively moderate longitudinal protrusion in the area at the pivot interface and, hence, yielding appropriate boundary conditions for optimized material flow during casting which is essential in an automated casting process.

With certain embodiments of the invention showing a very beneficial degree of integration of the pivot interface into the angled section, a forward pivot interface section associated to the forward free end section defines a forward pivot axis for a forward pivot arm, while a rearward pivot interface section associated to the rearward free end section defines a rearward pivot axis for a rearward pivot arm. The forward pivot axis and the rearward pivot axis, in the longitudinal direction, define a pivot axis distance, the pivot axis distance being 60% to 90%, preferably 70% to 80%, more preferably 72% to 78%, of the maximum longitudinal beam length.

It has turned out that, within the design specifications as outlined herein, suitability for automated casting may be achieved for running gear frame bodies having a considerable size in all three dimensions in space, in particular, not only in the "horizontal" plane (i.e. the plane parallel to the longitudinal direction and the transverse direction) but also in the height direction. Hence, with certain embodiments of the invention, in the height direction, one of the longitudinal beams, in a longitudinally central section, defines a longitudinal beam underside and a maximum central beam height of the longitudinal beam above the longitudinal beam underside, while one of the free end sections of the longitudinal beam defines a maximum beam height above the longitudinal beam underside. The maximum beam height is 200% to 450%, preferably 300% to 400%, more preferably 370% to 380%, of the maximum central beam height. Such a considerable height dimension of the pillar section facilitates, among others, a modification of the arrangement of the primary suspension unit (namely a switch from the known horizontal arrangement to an inclined arrangement) as has been explained above.

The transverse beam unit may be of any desired shape and design. For example, it may comprise one or more transverse beams interconnecting the two longitudinal beams. Such a transverse beam may have any desired cross-section. For example, such a transverse beam may have a generally box shaped design with a closed or generally ring-shaped cross-section. However, many other types of transverse beams may be chosen. For example, a conventional I-beam shape may be chosen.

Preferably, the transverse beam unit comprises at least one transverse beam, the at least one transverse beam, in a sectional plane parallel to the longitudinal direction and the height direction, defining a substantially C-shaped cross section. Such an open design has the advantage that (despite the general rigidity of the materials used) the transverse beam is comparatively torsionally soft, i.e. shows a comparatively low resistance against torsional moments about the transverse axis (compared to a closed, generally box shaped design of the transverse beam). This is particularly advantageous with respect to the derailment safety of the running gear since the running gear frame itself is able to provide some torsional deformation tending to equalize the wheel to rail contact forces on all four wheels.

Generally, any desired orientation of the substantially C-shaped cross section may be chosen. This may be done, in particular, as a function of the amount and/or orientation of the bending loads to be taken up by the transverse beam. Preferably, the substantially C-shaped cross section is arranged such that, in the longitudinal direction, it is open towards a free end of the frame body and, in particular, substantially closed towards a center of the frame body. Such a configuration is particularly beneficial if more than one transverse beams are used and a focus is to be put on a low torsional rigidity of the transverse beam unit.

The substantially C-shaped cross section may be arranged at any transverse position in the transverse beam unit. Preferably, the C-shaped cross section, in the transverse direction, extends over a transversally central section of the transverse beam unit, since at this location, a particularly beneficial influence on the torsional rigidity of the transverse beam unit may be achieved.

The substantially C-shaped cross section may extend over the entire extension of the transverse beam unit in the transverse direction. Preferably, the substantially C-shaped cross section extends, in the transverse direction, over a transverse dimension, the transverse dimension being at least 50%, preferably at least 70%, more preferably 80% to 95%, of a transverse distance between longitudinal center lines of the longitudinal beams in the area of the transverse beam unit. By this means a particularly advantageous torsional rigidity may be achieved even with such a grey cast iron frame body.

With preferred embodiments of the invention the at least one transverse beam is a first transverse beam and the transverse beam unit comprises a second transverse beam. Such a configuration has the advantage that, compared to a configuration with one single transverse beam, the mechanical properties may be more easily tuned to the requirements of the specific running gear. Preferably, the first transverse beam and the second transverse beam are substantially symmetric with respect to a plane of symmetry parallel to the transverse direction and the height direction, thereby providing identical running properties irrespective of the direction of travel.

Moreover, with transverse beams having C-shaped cross sections the open sides of which are facing away from each other, the increase in the overall torsional rigidity of the transverse beam unit resulting from the fact that two transverse beams are used may be kept comparatively low. This is due to the fact that the closed sides of the two transverse beams (in the longitudinal direction) are located comparatively centrally within the transverse beam unit, such that their contribution to the torsional resistance moment is comparatively low.

Furthermore, preferably, the first transverse beam and the second transverse beam are separated, in the longitudinal direction, by a gap having a longitudinal gap dimension. Such a gap between the two transverse beams has in the advantage that the bending resistance in the plane of main extension of the two beams is increased without adding to the mass of the frame body, such that a comparatively lightweight configuration is achieved. Furthermore, such a gap is readily available for receiving other components of the running gear, which is particularly beneficial in modern rail vehicles with their severe constraints regarding the building space available.

The longitudinal gap dimension may be selected as desired. Preferably, the longitudinal gap dimension is 70% to 120%, preferably 85% to 110%, more preferably 95% to 105%, of a minimum longitudinal dimension of one of the transverse beams in the longitudinal direction, thereby achieving a well-balanced configuration showing both, comparatively low torsional rigidity (about the transverse direction) and comparatively high bending rigidity (about the height direction).

The first and second transverse beam may be of any desired general shape. Preferably, the first transverse beam and the second transverse beam each define a transverse beam center line, at least one of the transverse beam center lines, at least section wise, having a generally curved or polygonal shape in a first plane parallel to the longitudinal direction and the transverse direction and/or a second plane parallel to the transverse direction and the height direction. Such generally curved or polygonal shapes of the transverse beam center lines have the advantage that the shape of the transverse beam may be adapted to the distribution of the loads acting on the respective transverse beam resulting in a comparatively smooth distribution of the stresses within the transverse beam and, ultimately, in a comparatively light weight and stress optimized frame body.

With certain preferred embodiments of the invention, the transverse beam unit is a locally waisted unit, in particular a centrally waisted unit, the transverse beam unit having a waisted section defining a minimum longitudinal dimension of the transverse beam unit in the longitudinal direction. Such a waisted configuration, among others, is advantageous in terms of the low torsional rigidity of the frame body about the transverse direction.

Generally, the extent of the waist may be chosen as a function of the mechanical properties, in particular, the torsional rigidity, to be achieved. Preferably, the minimum longitudinal dimension of the transverse beam unit is 40% to 90%, preferably 50% to 80%, more preferably 60% to 70%, of a maximum longitudinal dimension of the transverse beam unit in the longitudinal direction, the maximum longitudinal dimension, in particular, being defined at a junction of the transverse beam unit and one of the longitudinal beams.

With advantageous embodiments of the invention the free and section, in a section facing away from the primary spring interface, forms a stop interface for a stop device. Preferably, the stop device is a rotational stop device and/or longitudinal stop device, which may also be adapted to form a traction link between the frame body and a component, in particular a bolster or a wagon body, supported on the frame body. It will be appreciated that such a configuration is particularly beneficial since it provides a high degree of functional integration leading to a comparatively lightweight overall design.

The present invention furthermore relates to a rail vehicle unit comprising a first running gear unit according to the invention supported on two wheel units via primary spring units and pivot arms connected to a frame body of the first running gear unit to form a first running gear. A further rail vehicle component may be supported on the frame body, the rail vehicle component, in particular, being a bolster or a wagon body.

It will be appreciated that, according to a further aspect of the present invention, the frame body may be formed as a standardized component which may be used for different types of running gears. Customization of the respective frame body to the specific type of running gear type may be achieved by additional type specific components mounted to the standardized frame body. Such an approach is highly advantageous in terms of its commercial impact. This is due to the fact that, in addition to the considerable savings achieved due to the automated casting process, only one single type of frame body has to be manufactured, which brings along a further considerable reduction in costs.

Hence, preferably, the rail vehicle unit comprises a second running gear frame according to the invention supported on two wheel units via primary spring units and pivot arms connected to a frame body of the second running gear frame to form a second running gear. The first running gear may be a driven running gear comprising a drive unit, while the second running gear may be a non-driven running gear having a no drive unit. Preferably, at least the frame body of the first running gear frame and the frame body of the second running gear frame are substantially identical.

It should be noted in this context that customization of the running gear to a specific type or function on the basis of identical frame bodies is not limited to a differentiation in terms of driven and non-driven running gears. Any other functional components may be used to achieve a corresponding functional differentiation between such running gears on the basis of standardized identical frame bodies.

Further embodiments of the present invention will become apparent from the dependent claims and the following description of preferred embodiments which refers to the appended figures.

DETAILED DESCRIPTION OF THE INVENTION

Figure 1:
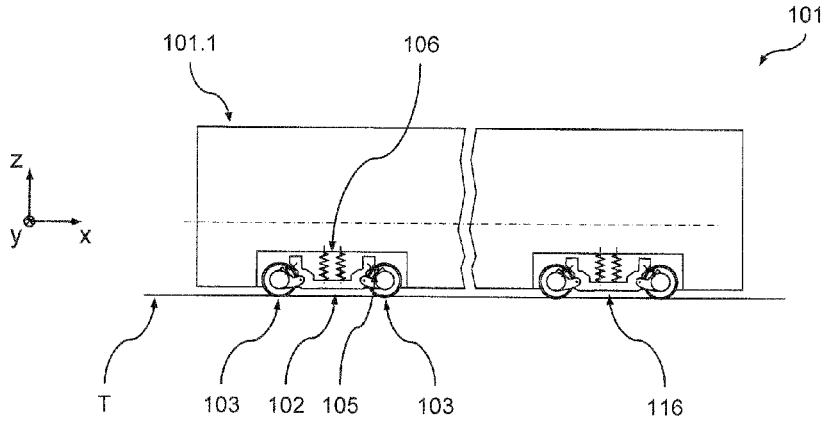
FIG. 1 is a schematic side view of a part of a preferred embodiment of a rail vehicle according to the present invention with a preferred embodiment of a running gear unit according to the present invention.

With reference to FIGS. 1 to 6 a preferred embodiment of a rail vehicle 101 according to the present invention comprising a preferred embodiment of a running gear 102 according to the invention will now be described in greater detail. In order to simplify the explanations given below, an xyz-coordinate system has been introduced into the Figures, wherein (on a straight, level track T) the x-axis designates the longitudinal direction of the rail vehicle 101, the y-axis designates the transverse direction of the rail vehicle 101 and the z-axis designates the height direction of the rail vehicle 101 (the same, of course, applies for the running gear 102). It will be appreciated that all statements made in the following with respect to the position and orientation of components of the rail vehicle, unless otherwise stated, refer to a static situation with the rail vehicle 101 standing on a straight level track under nominal loading.

The vehicle 101 is a low floor rail vehicle such as a tramway or the like. The vehicle 101 comprises a wagon body 101.1 supported by a suspension system on the running gear 102. The running gear 102 comprises two wheel units in the form of wheel sets 103 supporting a running gear frame 104 via a primary spring unit 105. The running gear frame 104 supports the wagon body via a secondary spring unit 106.

The running gear frame 104 has a frame body 107 comprising two longitudinal beams 108 and a transverse beam unit 109 providing a structural connection between the longitudinal beams 108 in the transverse direction, such that a substantially H-shaped configuration is formed. Each longitudinal beam 108 has two free end sections 108.1 and a central section 108.2. The central section 108.2 is connected to the transverse beam unit 109 while the free end sections 108.1 form a primary suspension interface 110 for a primary suspension device 105.1 of the primary suspension unit 105 connected to the associated wheel unit 103. In the present example, a compact and robust rubber-metal-spring is used for the primary spring device 105.1.

Each longitudinal beam 108 has an angled section 108.3 associated to one of the free end sections 108.1. Each angled section 108.3 is arranged such that the free end section 108.1 forms a pillar section mainly extending in the height direction. Hence, basically, the frame body 107 has a comparatively complex, generally three-dimensional geometry.

Each longitudinal beam 108 has a pivot interface section 111 associated to the free end section 108.1. The pivot interface section 111 forms a pivot interface for a pivot arm 112 rigidly connected to a wheel set bearing unit 103.1 of the associated wheel unit 103. The pivot arm 112 is pivotably connected to the frame body 107 via a pivot bolt connection 113. The pivot bolt connection 113 comprises a pivot bolt 113.1 defining a pivot axis 113.2. The bolt 113.1 is inserted into matching recesses in a forked end of the pivot arm 112 and a pivot interface recess 111.1 in a lug 111.2 of the pivot interface section 111 (the lug 111.2 being received between the end parts of the pivot arm 112).

To reduce the complexity of the frame body 107, the respective pivot interface section 111 is integrated into to the angled section 108.3 of the longitudinal beams 108, such that, nevertheless, a very compact arrangement is achieved. More precisely, integration of the pivot interface section 111 into the angled section 108.3 leads to a comparatively smooth, unbranched geometry of the frame body.

This compact, smooth and unbranched arrangement, among others, makes it possible to form the frame body 107 as a monolithically cast component. More precisely, the frame body 107 is formed as a single piece cast in an automated casting process from a grey cast iron material. The grey cast iron material has the advantage that it comprises a particularly good flow capability during casting due to its high carbon content and thus leads to a very high level of process reliability.

Casting is done in conventional molding boxes of an automated casting production line. Consequently, production of the frame body 107 is significantly simplified and rendered more cost effective than in conventional solutions with welded frame bodies. In fact, it has turned out that (compared to a conventional welded frame body) a cost reduction by more than 50% may be achieved with such an automated casting process.

The grey cast iron material used in the present example is a so called nodular graphite iron cast material or spheroidal graphite iron (SGI) cast material as currently specified in European Norm EN 1563. More precisely, a material such as EN-GJS-400-18U LT is used, which provides a good compromise between strength, elongation at fracture and toughness, in particular at low temperatures. Obviously, depending on the mechanic requirements on the frame body, any other suitable cast material as outlined above may be used.

To achieve proper integration of the pivot interface section 111 into the angled section 108.3, the respective pivot interface section 111, in the longitudinal direction (x-axis), is arranged to be retracted behind the associated free end section 108.1.

In the present example, a forward free end section 108.1 and a rearward free end section 108.1 of each longitudinal beam 108, in the longitudinal direction, define a maximum longitudinal beam length $L_{LB,max}$ of the longitudinal beam 108. Furthermore, a forward pivot interface section 111 (associated to the forward free end section 108.1) and a rearward pivot interface section 111 (associated to the rearward free end section 108.1), in the longitudinal direction, define a maximum pivot interface dimension $L_{PI,max}$ of the longitudinal beam 108.

In the present example, the maximum pivot interface dimension $L_{PI,max}$ is about 92% of the maximum longitudinal beam length $L_{LB,max}$, thereby achieving a very compact design showing no longitudinal protrusion in the area at the pivot interface 111 and, hence, yielding appropriate boundary conditions for optimized material flow during casting which is essential in the automated casting process used.

Furthermore, the forward pivot axis 113.2 (for the forward pivot arm 112) and the rearward pivot axis 113.2 (for the rearward pivot arm 112), in the longitudinal direction, define a pivot axis distance $L_{PA}$ being about 76% of the maximum longitudinal beam length $L_{LB,max}$.

The frame body 107 of the present embodiment is suitable for automated casting despite its considerable size in all three dimensions (x,y,z) in space, in particular, its considerable size not only in the "horizontal" plane (i.e. the xy-plane) but also its considerable size in the height direction (z-axis). More precisely, as can be seen from FIG. 3, in the height direction, the longitudinally central section 108.2 defines a longitudinal beam underside and a maximum central beam height $H_{LBC,max}$ of the longitudinal beam 108 above the longitudinal beam underside, while the free end sections 108.1 define a maximum beam height $H_{LB,max}$ above the longitudinal beam underside. Despite the fact that the maximum beam height $H_{LB,max}$ of the present embodiment is as high as about 380% of the maximum central beam height $H_{LBC,max}$, the frame body 107 may be cast as a single monolithic component.

According to a further aspect of the present invention (as can be seen, in particular, from FIG. 5) a considerable reduction in the building space (required for frame body 107 within the running gear 102) is accomplished in that the primary suspension interface 110 is configured such that the total resultant support force $F_{TRS}$ acting in the area of the respective free end 108.1 (i.e. the total force resulting from all the support forces acting via the primary suspension 105 in the region the free end 108.1, when the running gear frame 104 is supported on the wheel unit 103) is substantially parallel with respect to the xz-plane, while in being inclined with respect to the longitudinal direction (x-axis) by a primary suspension angle $\alpha_{PSF,x}$ and inclined with respect to the height direction (z-axis) by a complementary primary suspension angle $$\alpha_{PSF,z}=90°-\alpha_{PSF,x}. \quad (1)$$

Such an inclination of the total resultant support force $F_{TRS}$, compared to a configuration as known from DE 41 36 926 A1, allows the primary suspension device 105.1 to move closer to the wheel set 103, more precisely closer to the axis of rotation 103.2 of the wheel set 103. This has not only the advantage that the primary suspension interface 110 also can be arranged more closely to the wheel unit, which clearly saves space in the central part of the running gear 102. Furthermore, the pivot arm 112 connected to the wheel set bearing unit 103.1 can be of smaller, more lightweight and less complex design.

Furthermore, such an inclined total resultant support force $F_{TRS}$ yields the possibility to realize a connection between the pivot arm 112 and the frame body 107 at the pivot interface 111 which is both self adjusting under load (due to the components of the total resultant force $F_{TRS}$ acting in the longitudinal direction and the height direction) while being easily dismounted in absence of the support load $F_{TRS}$ as it is described in greater detail in pending German patent application No. 10 2011 110 090.7 (the entire disclosure of which is incorporated herein by reference).

Finally, such a design has the advantage that, not least due to the fact that the primary suspension interface section 110 moves closer to the wheel set 103, it further facilitates automated production of the frame body 107 using an automated casting process.

Although, basically, the total resultant support force $F_{TRS}$ may have any desired and suitable inclination with respect to the longitudinal direction and the height direction, in the present example, the total resultant support force $F_{TRS}$ is inclined with respect to the longitudinal direction by a primary suspension angle $\alpha_{PSF,x}=45°$. Consequently, the total resultant support force is inclined with respect to the height direction by a complementary primary suspension angle $\alpha_{PSF,z}=90°-\alpha_{PSF,x}=45°$. Such an inclination provides a particularly compact and, hence, favorable design. Furthermore, it also provides an advantageous introduction of the support loads $F_{TRS}$ from the wheel set 103 into the frame body 107. Finally, as a consequence, the pillar section or end section 108.1 may be formed in a slightly forward leaning configuration which is favorable in terms of facilitating cast material flow and, hence, use of an automated casting process.

Figure 5:
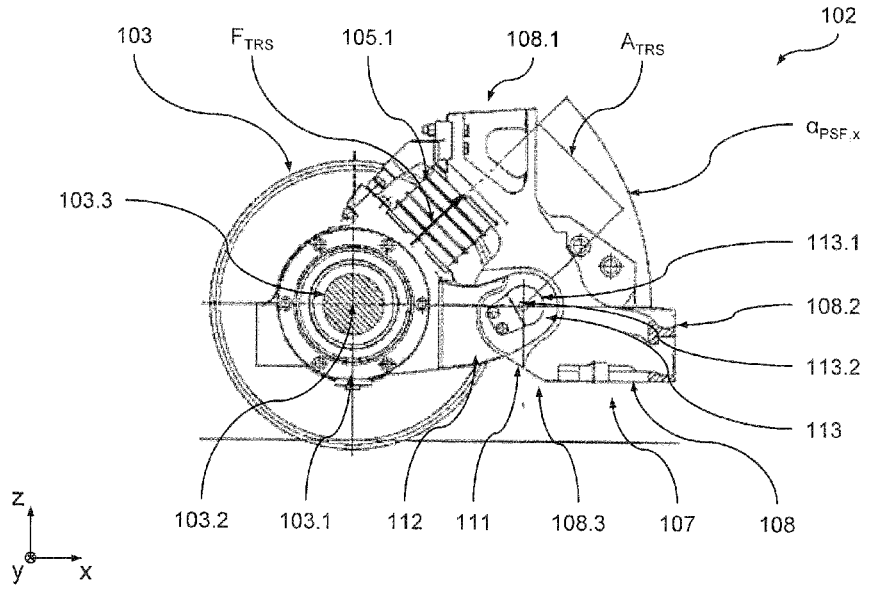
FIG. 5 is a schematic sectional view of a part of the running gear unit along line V-V of FIG. 1.

As may be further seen from FIG. 5, the primary suspension interface 110 and the primary suspension device 105.1 are arranged such that the total resultant support force $F_{TRS}$ intersects a wheel set shaft 103.3 of the wheel set 103, leading to a favorable introduction of the support loads from the wheel set 103 into the primary suspension device 105.1 and onwards into the frame body 107. More precisely, the total resultant support force $F_{TRS}$ intersects the axis of wheel rotation 103.2 of the wheel shaft 103.3.

Such a configuration, among others, leads to a comparatively short lever arm of the total resultant support force $F_{TRS}$ (for example, a lever arm $A_{TRS}$ at the location of the pivot bolt 113.1) and, hence, comparatively low bending moments acting in the longitudinal beam 108, which, in turn, allows a more lightweight design of the frame body 107.

A further advantage of the configuration as outlined above is the fact that the pivot arm 112 may have a very simple and compact design. More precisely, in the present example, the pivot arm 112 integrating the wheel set bearing unit 103.1, apart from the forked end section (receiving the pivot bolt 113.1) simply has to provide a corresponding support surface for the primary spring device 105.1 located close to the outer circumference of the wheel set bearing unit 103.1. Hence, compared to known configurations, no complex arms or the like are necessary for introducing the support forces into the primary spring device 105.1.

Although, basically, the primary suspension interface 110 may have any desired shape, in the present example, the primary suspension interface 110 is a simple planar surface 110.1 laterally flanked by two protrusions 110.2 (against which mating surfaces of the primary suspension device 105.1 rest, among others, for centering purposes). The planar surface 110.1 defines a main interface plane configured to take a major fraction of the total resultant support force $F_{TRS}$.

The main interface plane 110.1 is configured to be substantially perpendicular to the total resultant support force $F_{TRS}$ as well as substantially parallel to the transverse direction (y-axis). As a consequence, the main interface plane 110.1 is inclined with respect to the longitudinal direction and inclined with respect to the height direction. More precisely, the main interface plane 110.1 is inclined with respect to the height direction by a main interface plane angle $$\alpha_{MIP,z}=90°-\alpha_{PSF,z}=\alpha_{PSF,x}. \quad (2)$$

Hence, in the present case, the main interface plane 110.1 is inclined with respect to the height direction by a main interface plane angle $\alpha_{MIP,z}=45°$.

To achieve the slightly forwardly leaning configuration of the free end section 108.1 and its advantages as described above, in the present example, the pivot interface section 111, in the longitudinal direction, is retracted behind a center 110.3 of the primary suspension interface 110. To this end, in the present embodiment, the pivot axis distance $L_{PA}$ is 82% of a primary suspension interface center distance $L_{PSIC}$ defined (in the longitudinal direction) by the centers 110.3 of a forward primary suspension interface 110 and a rearward primary suspension interface 110 of the longitudinal beams 108.

The transverse beam unit 109 comprises two transverse beams 109.1, which are arranged to be substantially symmetric to each other with respect to a plane of symmetry parallel to the yz-plane and arranged centrally within the frame body 107. The transverse beams 109.1 (in the longitudinal direction) are separated by a gap 109.5.

Figure 3:
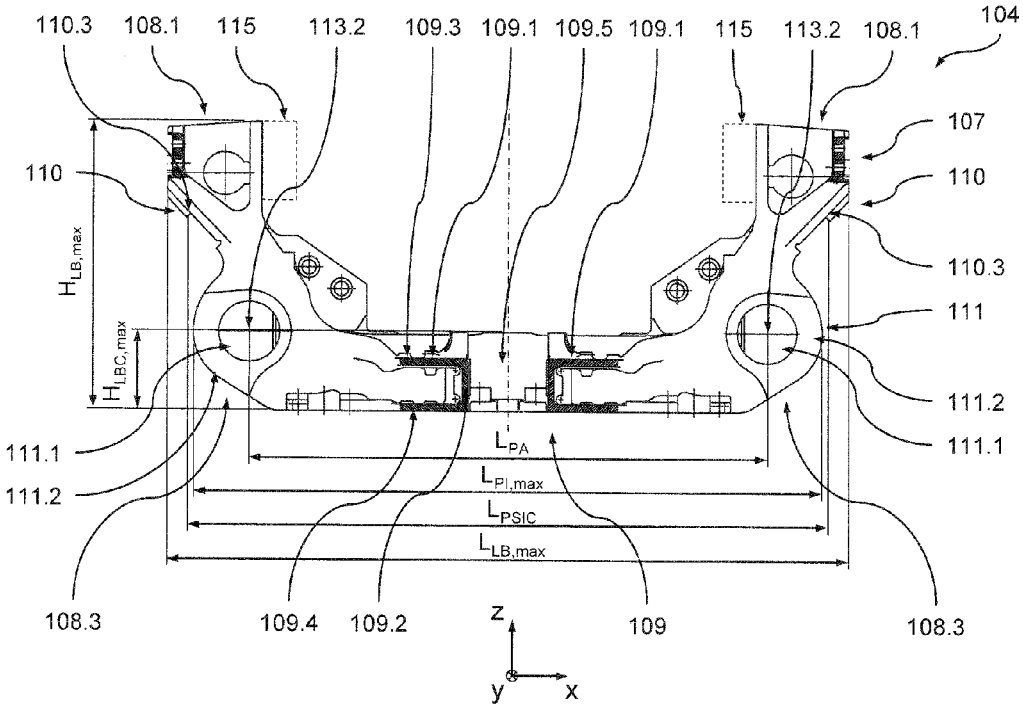
FIG. 3 is a schematic sectional view of the frame body of FIG. 2 along line III-III of FIG. 1.
Figure 4:
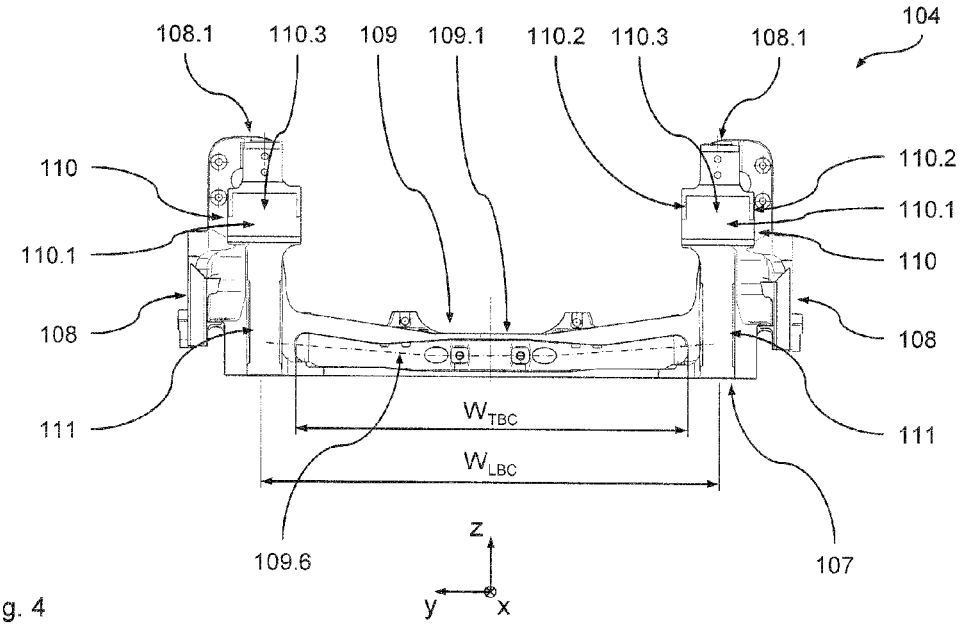
FIG. 4 is a schematic frontal view of the frame body of FIG. 2.

As can be seen from FIG. 3, each transverse beam 109.1, in a sectional plane parallel to the xz-plane, has a substantially C-shaped cross section with an inner wall 109.2, an upper wall 109.3, and a lower wall 109.4. The C-shaped cross section is arranged such that, in the longitudinal direction, it is open towards the (more closely located) free end of the frame body 107, while it is substantially closed by the inner wall 109.2 located adjacent to the center of the frame body 107. In other words, the open sides of the transverse beams 109.1 are facing away from each other.

Such an open design of the transverse beam 109.1 has the advantage that (despite the general rigidity of the materials used) not only the individual transverse beam 109.1 is comparatively torsionally soft, i.e. shows a comparatively low resistance against torsional moments about the transverse y-axis (compared to a closed, generally box shaped design of the transverse beam). The same applies to the transverse beam unit 109 as a whole, since the inner walls 109.2 (in the longitudinal direction) are located comparatively centrally within the transverse beam unit 109, such that their contribution to the torsional resistance moment about the transverse y-axis is comparatively low.

Furthermore, the gap 109.5, in a central area of the frame body 107, has a maximum longitudinal gap dimension $L_{G,max}$, which is about 100% of a minimum longitudinal dimension $L_{TB,min}$ of one of the transverse beams 109.1 in the longitudinal direction (in the central area of the frame body 107). The gap 109.5 has the advantage that the bending resistance in the plane of main extension of the two transverse beams 109.1 (parallel to the xy-plane) is increased without adding to the mass of the frame body 107, such that a comparatively lightweight configuration is achieved.

Figure 6:
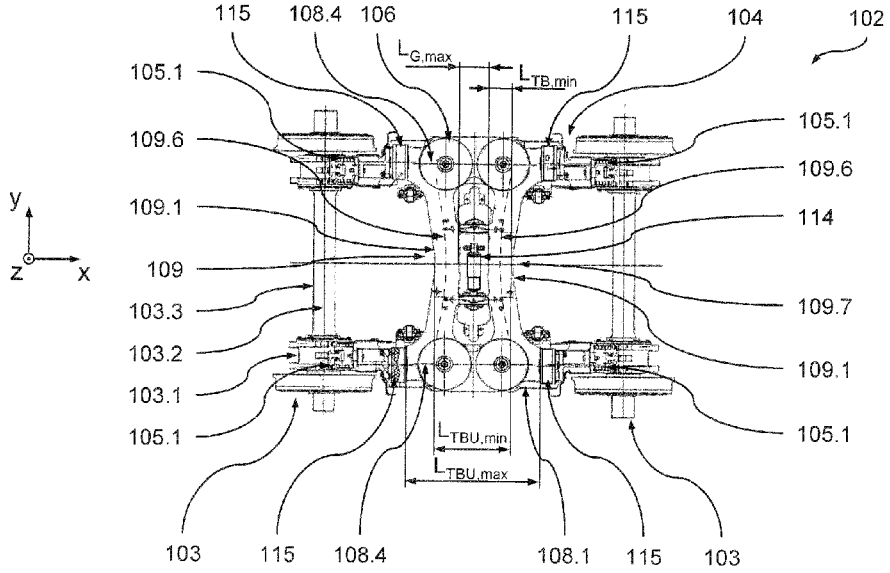
FIG. 6 is a schematic top view of the running gear unit of FIG. 1.

Furthermore, the gap 109.5 is readily available for receiving other components of the running gear 102 (such as a transverse damper 114 as shown in FIG. 6), which is particularly beneficial in modern rail vehicles with their severe constraints regarding the building space available.

The C-shaped cross section extends over a transversally central section of the transverse beam unit 109, since, at this location, a particularly beneficial influence on the torsional rigidity of the transverse beam unit is achieved. In the present embodiment, the substantially C-shaped cross section extends over the entire extension of the transverse beam unit in the transverse direction (i.e. from one longitudinal beam 108 to the other longitudinal beam 108). Hence, in the present example, the C-shaped cross section extends over a transverse dimension $W_{TBC}$, which is 85% of a transverse distance $W_{LBC}$ between longitudinal center lines 108.4 of the longitudinal beams 108 in the area of the transverse beam unit 109. By this means a particularly advantageous torsional rigidity may be achieved even with such a grey cast iron frame body 107.

As far as the extension in the transverse direction is concerned, the same (as for the C-shaped cross-section) also applies to the extension of the gap 109.5. Furthermore, it should be noted that the longitudinal gap dimension doesn't necessarily have to be the same along the transverse direction. Any desired gap width may be chosen as needed.

In the present example, each transverse beam 109.1 defines a transverse beam center line 109.6, which has a generally curved or polygonal shape in a first plane parallel to the xy-plane and in a second plane parallel to the yz-plane. Such generally curved or polygonal shapes of the transverse beam center lines 109.6 have the advantage that the shape of the respective transverse beam 109.1 is adapted to the distribution of the loads acting on the respective transverse beam 109.1 resulting in a comparatively smooth distribution of the stresses within the respective transverse beam 109.1 and, ultimately, in a comparatively lightweight and stress optimized frame body 107.

Figure 2:
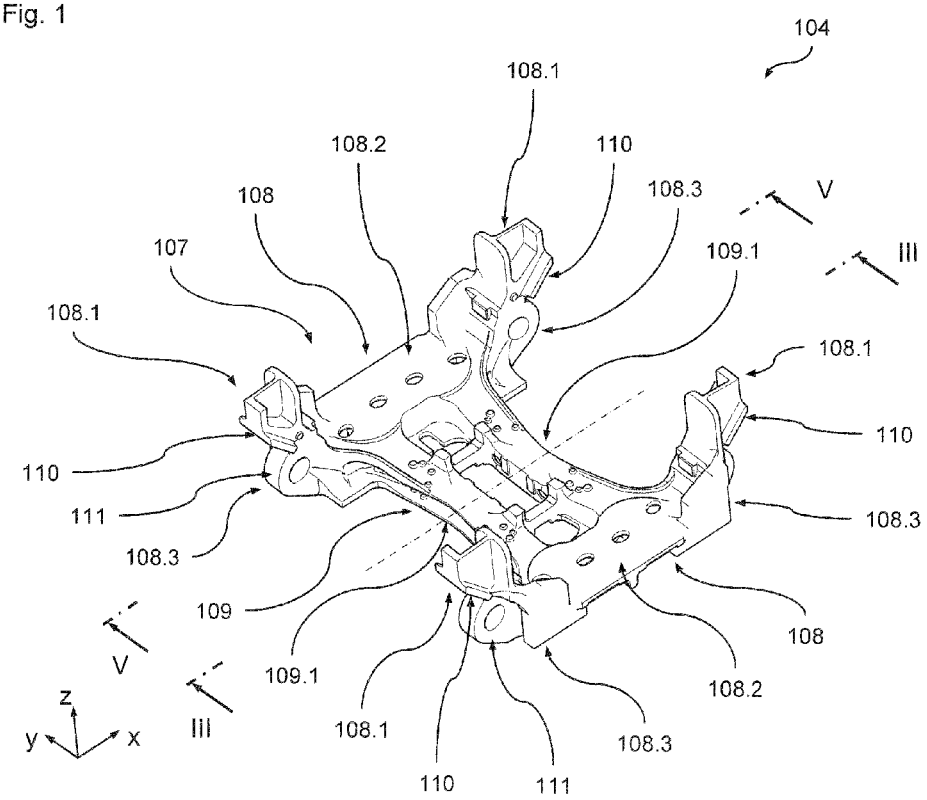
FIG. 2 is a schematic perspective view of a frame body of the running gear unit of FIG. 1.

As a consequence, as can be seen from FIGS. 2 and 6, the transverse beam unit 109 is a centrally waisted unit with a waisted central section 109.7 defining a minimum longitudinal dimension of the transverse beam unit $L_{TBU,min}$ (in the longitudinal direction) which, in the present example, is 65% of a maximum longitudinal dimension of the transverse beam unit $L_{TBU,min}$ (in the longitudinal direction). This maximum longitudinal dimension, in the present example, is defined at the junction of the transverse beam unit 109 and the longitudinal beams 108.

Generally, the extent of the waist of the transverse beam unit 109 may be chosen as a function of the mechanical properties of the frame body 107 (in particular, the torsional rigidity of the frame body 107) to be achieved. In any case, with the transverse beam unit design as outlined herein, a well-balanced configuration is achieved showing both, comparatively low torsional rigidity (about the transverse direction) and comparatively high bending rigidity (about the height direction). This configuration is particularly advantageous with respect to the derailment safety of the running gear 102 since the running gear frame 104 is able to provide some torsional deformation tending to equalize the wheel to rail contact forces on all four wheels of the wheel sets 103.

And can be further seen from FIGS. 3 and 6, in the present example, the free end section 108.1, in a section facing away from the primary spring interface 110, forms a stop interface for a stop device 115. The stop devices 115 integrate the functionality of a rotational stop device and a longitudinal stop device for the wagon body 101.1. Furthermore, the stop devices 115 also are adapted to form a traction link between the frame body 107 and the wagon body 101.1 supported on the frame body 107. It will be appreciated that such a configuration is particularly beneficial since it provides a high degree of functional integration leading to a comparatively lightweight overall design.

As can be seen from FIG. 1, the wagon body 101.1 (more precisely, either the same part of the wagon body 101.1 also supported on the first running gear 102 or another part of the wagon body 101) is supported on a further, second running gear 116. The second running gear 116 is identical to the first running the 102 in all the parts described above. However, while the first running gear 102 is a driven running gear with a drive unit (not shown) mounted to the frame body 107, the second running gear 116 is a non-driven running gear, having no such drive unit mounted to the frame body 107.

Hence, according to a further aspect of the present invention, the frame body 107 forms a standardized component which used for both, the first running gear 102 and the second running gear, i.e. different types of running gear. Customization of the respective frame body 107 to the specific type of running gear type may be achieved by additional type specific components mounted to the standardized frame body 107. Such an approach is highly advantageous in terms of its commercial impact. This is due to the fact that, in addition to the considerable savings achieved due to the automated casting process, only one single type of frame body 107 has to be manufactured, which brings along a further considerable reduction in costs.

It should again be noted in this context that customization of the running gear 102, 116 to a specific type or function on the basis of identical frame bodies 107 is not limited to a differentiation in terms of driven and non-driven running gears. Any other functional components (such as e.g. specific types of brakes, tilt systems, rolling support systems, etc.) may be used to achieve a corresponding functional differentiation between such running gears on the basis of standardized identical frame bodies 107.

Although the present invention, in the foregoing, only has been described in the context of running gears with inboard wheelset bearings, it should be noted that the present invention may also be used in the context of running gears with outboard wheelset bearings. This will require only slight modifications of the running gear frame, in particular, the longitudinal beams, location of components such as magnetic brakes etc. for adaptation to different track gauges.

Although the present invention in the foregoing has only a described in the context of low-floor rail vehicles, it will be appreciated, however, that it may also be applied to any other type of rail vehicle in order to overcome similar problems with respect to a simple solution for reducing the manufacturing effort.

The invention claimed is:

1. A running gear unit comprising:

a running gear frame body defining a longitudinal direction, a transverse direction and a height direction;

said frame body comprising two longitudinal beams and a transverse beam unit providing a structural connection between said longitudinal beams in said transverse direction, such that a substantially H-shaped configuration is formed, each longitudinal beam having a suspension interface section associated to a free end section of said longitudinal beam and forming a primary suspension interface for a primary suspension device connected to an associated wheel unit;

each longitudinal beam having a pivot interface section associated to said primary suspension interface section and forming a pivot interface for a pivot arm connected to said associated wheel unit;

said primary suspension interface being configured to take a total resultant support force acting in the area of said free end section when said frame body is supported on said associated wheel unit;

wherein said primary suspension interface is configured such that said total resultant support force is inclined with respect to said longitudinal direction and inclined with respect to said height direction, said primary suspension interface defines a main interface plane;

said main interface plane being configured to take at least a major fraction of said resultant support force;

said main interface plane being inclined with respect to said longitudinal direction and inclined with respect to said height direction;

said main interface plane being inclined with respect to said height direction by a main interface plane angle, said main interface plane angle ranging from 40° to 50°; and said main interface plane being substantially parallel with respect to said transverse direction.

2. The running gear unit according to claim 1, wherein, said total resultant support force is inclined with respect to said height direction by a primary suspension angle;

said primary suspension angle ranging from 20° to 80°.

3. The running gear unit according to claim 1, wherein, said associated wheel unit is connected to said frame body via said pivot arm pivotably linked to said pivot interface;

said primary suspension interface and said primary suspension device being configured such that said total resultant support force intersects a wheel shaft of said wheel unit.

4. The running gear unit according to claim 1, wherein, said pivot interface section, in said longitudinal direction, is arranged to be at least partially retracted behind a center of said primary suspension interface;

a center of a forward primary suspension interface and a center of a rearward primary suspension interface of one of said longitudinal beams, in said longitudinal direction, defining a maximum primary suspension interface center distance;

a forward pivot interface section being associated to said forward primary suspension interface and defining a forward pivot axis for a forward pivot arm;

a rearward pivot interface section being associated to said rearward primary suspension interface and defining a rearward pivot axis for a rearward pivot arm;

said forward pivot axis and said rearward pivot axis, in said longitudinal direction, defining a pivot axis distance;

said pivot axis distance being 60% to 105% of said maximum primary suspension interface center distance.

5. The running gear unit according to claim 1, wherein, said primary suspension interface is configured as an interface for a single primary suspension device;

said primary suspension device being formed by a single primary suspension unit;

said primary suspension unit being formed by a single primary suspension spring.

6. The running gear unit according to claim 1, wherein, said frame body is formed as a monolithically cast component made of a grey cast iron material;

said frame body being made of a spheroidal graphite iron cast material;

said spheroidal graphite iron cast material being one of EN-GJS-400-18U LT and EN-GJS-350-22-LT.

7. The running gear unit according to claim 1, wherein, each longitudinal beam has an angled section associated to said free end section;

said angled section being configured such that said free end section (108.1) forms a pillar section at least mainly extending in said height direction:

said pivot interface section being associated to said angled section;

said pivot interface section being integrated into to said angled section.

8. The running gear unit according to claim 1, wherein said pivot interface section, in said longitudinal direction, is arranged to be at least partially retracted behind said associated free end section;

a forward free end section and a rearward free end section of one of said longitudinal beams, in said longitudinal direction, defining a maximum longitudinal beam length of said longitudinal beam;

a forward pivot interface section associated to said forward free end section defining a forward pivot axis for a forward pivot arm;

a rearward pivot interface section associated to said rearward free end section defining a rearward pivot axis for a rearward pivot arm;

said forward pivot axis and said rearward pivot axis, in said longitudinal direction, defining a pivot axis distance;

said pivot axis distance being 60% to 90% of said maximum longitudinal beam length.

9. The running gear unit according to claim 1, wherein, in said height direction, one of said longitudinal beams, in a longitudinally central section, defines a longitudinal beam underside and a maximum central beam height of said longitudinal beam above said longitudinal beam underside, and one of said free end sections of said longitudinal beam defines a maximum beam height above said longitudinal beam underside;

said maximum beam height being 200% to 450% of said maximum central beam height.

10. The running gear unit according to claim 1, wherein, said transverse beam unit comprises at least one transverse beam;

said at least one transverse beam, in a sectional plane parallel to said longitudinal direction and said height direction, defining a substantially C-shaped cross section;

said substantially C-shaped cross section being arranged such that, in said longitudinal direction, it is open towards a free end of said frame body and substantially closed towards a center of said frame body;

said substantially C-shaped cross section extending, in said transverse direction, over a transversally central section of said transverse beam unit;

said substantially C-shaped cross section extending, in said transverse direction, over a transverse dimension, said transverse dimension being at least 50% of a transverse distance between longitudinal center lines of said longitudinal beams in the area of said transverse beam unit.

11. The running gear unit according to claim 10, wherein, said at least one transverse beam is a first transverse beam and said transverse beam unit comprises a second transverse beam;

said first transverse beam and said second transverse beam being substantially symmetric with respect to a plane of symmetry parallel to said transverse direction and said height direction;

said first transverse beam and said second transverse beam being separated, in said longitudinal direction, by a gap having a longitudinal gap dimension;

said longitudinal gap dimension being 70% to 120% of a minimum longitudinal dimension of one of said transverse beams in said longitudinal direction;

said first transverse beam and said second transverse beam each defining a transverse beam center line, at least one of said transverse beam center lines, at least section wise, having a generally curved or polygonal shape in a first plane parallel to said longitudinal direction and said transverse direction or a second plane parallel to said transverse direction and said height direction.

12. The running gear unit according to claim 1, wherein, said transverse beam unit is a locally waisted unit;

said transverse beam unit having a waisted section defining a minimum longitudinal dimension of said transverse beam unit in said longitudinal direction;

said minimum longitudinal dimension of said transverse beam unit being 40% to 90% of a maximum longitudinal dimension of said transverse beam unit (109) in said longitudinal direction, said maximum longitudinal dimension being defined at a junction of said transverse beam unit and one of said longitudinal beams.

13. The running gear unit according to claim 1, wherein, said free end section, in a section facing away from a primary spring interface, forms a stop interface for a stop device;

said stop device being a rotational stop device or longitudinal stop device;

said stop device being adapted to form a traction link between said frame body and a component.

14. A rail vehicle unit, comprising a first running gear unit according to claim 1 supported on two wheel units via primary spring units and pivot arms connected to a frame body of said first running gear unit to form a first running gear;

a rail vehicle component being supported on said frame body, said rail vehicle component being a bolster or a wagon body;

said rail vehicle unit comprising a second running gear unit supported on two wheel units via primary spring units and pivot arms connected to a frame body of said second running gear unit to form a second running gear;

said first running gear being a driven running gear comprising a drive unit, said second running gear being a non-driven running gear having a no drive unit, at least said frame body of a first running gear frame and said frame body of a second running gear frame being substantially identical.

15. A running gear unit comprising:

a running gear frame body defining a longitudinal direction, a transverse direction and a height direction;

said frame body comprising two longitudinal beams and a transverse beam unit providing a structural connection between said longitudinal beams in said transverse direction, such that a substantially H-shaped configuration is formed, each longitudinal beam having a suspension interface section associated to a free end section of said longitudinal beam and forming a primary suspension interface for a primary suspension device connected to an associated wheel unit;

each longitudinal beam having a pivot interface section associated to said primary suspension interface section and forming a pivot interface for a pivot arm connected to said associated wheel unit;

said primary suspension interface being configured to take a total resultant support force acting in the area of said free end section when said frame body is supported on said associated wheel unit;

wherein said primary suspension interface is configured such that said total resultant support force is inclined with respect to said longitudinal direction and inclined with respect to said height direction, said pivot interface section, in said longitudinal direction, is arranged to be at least partially retracted behind a center of said primary suspension interface;

a center of a forward primary suspension interface and a center of a rearward primary suspension interface of one of said longitudinal beams, in said longitudinal direction, defining a maximum primary suspension interface center distance;

a forward pivot interface section being associated to said forward primary suspension interface and a forward pivot axis for a forward pivot arm;

a rearward pivot interface section being associated to said rearward primary suspension interface and defining a rearward pivot axis for a rearward pivot arm;

said forward pivot axis and said rearward pivot axis, in said longitudinal direction, defining a pivot axis distance; and said pivot axis distance being 60% to 105% of said maximum primary suspension interface center distance.

16. A running gear unit comprising:

a running gear frame body defining a longitudinal direction, a transverse direction and a height direction;

said frame body comprising two longitudinal beams and a transverse beam unit providing a structural connection between said longitudinal beams in said transverse direction, such that a substantially H-shaped configuration is formed, each longitudinal beam having a suspension interface section associated to a free end section of said longitudinal beam and forming a primary suspension interface for a primary suspension device connected to an associated wheel unit;

each longitudinal beam having a pivot interface section associated to said primary suspension interface section and forming a pivot interface for a pivot arm connected to said associated wheel unit;

said primary suspension interface being configured to take a total resultant support force acting in the area of said free end section when said frame body is supported on said associated wheel unit;

wherein said primary suspension interface is configured such that said total resultant support force is inclined with respect to said longitudinal direction and inclined with respect to said height direction, said pivot interface section, in said longitudinal direction, is arranged to be at least partially retracted behind said associated free end section;

a forward free end, section and a rearward free end section of one of said longitudinal beams, in said longitudinal direction, defining a maximum longitudinal beam length of said longitudinal beam;

a forward pivot interface section associated to said forward free end section defining a forward pivot axis for a forward pivot arm;

a rearward pivot interface section associated to said rearward free end section defining a rearward pivot axis for a rearward pivot arm;

said forward pivot axis and said rearward pivot axis, in said longitudinal direction, defining a pivot axis distance; and said pivot axis distance being 60% to 90% of said maximum longitudinal beam length.

17. A running gear unit comprising:

a running gear frame body defining a longitudinal direction, a transverse direction and a height direction;

said frame body comprising two longitudinal beams and a transverse beam unit providing a structural connection between said longitudinal beams in said transverse direction, such that a substantially H-shaped configuration is formed, each longitudinal beam having a suspension interface section associated to a free end section of said longitudinal beam and forming a primary suspension interface for a primary suspension device connected to an associated wheel unit;

each longitudinal beam having a pivot interface section associated to said primary suspension interface section and forming a pivot interface for a pivot arm connected to said associated wheel unit;

said primary suspension interface being configured to take a total resultant support force acting in the area of said free end section when said frame body is supported on said associated wheel unit;

wherein said primary suspension interface is configured such that said total resultant support force is inclined with respect to said longitudinal direction and inclined with respect to said height direction, in said height direction, one of said longitudinal beams, in a longitudinally central section, defines a longitudinal beam underside and a maximum central beam height of said longitudinal beam above said longitudinal beam underside, one of said free end sections of said longitudinal beam defines a maximum beam height above said longitudinal beam underside; and said maximum beam height being 200% to 450% of said maximum central beam height.

18. A running gear unit comprising:

a running gear frame body defining a longitudinal direction, a transverse direction and a height direction;

said frame body comprising two longitudinal beams and a transverse beam unit providing a structural connection between said longitudinal beams in said transverse direction, such that a substantially H-shaped configuration is formed, each longitudinal beam having a suspension interface section associated to a free end section of said longitudinal beam and forming a primary suspension interface for a primary suspension device connected to an associated wheel unit;

each longitudinal beam having a pivot interface section associated to said primary suspension interface section and forming a pivot interface for a pivot arm connected to said associated wheel unit;

said primary suspension interface being configured to take a total resultant support force acting in the area of said free end section when said frame body is supported on said associated wheel unit;

wherein said primary suspension interface is configured such that said total resultant support force is inclined with respect to said longitudinal direction and inclined with respect to said height direction, said transverse beam unit comprises at least one transverse beam;

said at least one transverse beam, in a sectional plane parallel to said longitudinal direction and said height direction, defining a substantially C-shaped cross section;

said substantially C-shaped cross section being arranged such that, in said longitudinal direction, it is open towards a free end of said frame body and substantially closed towards a center of said frame body;

said substantially C-shaped cross section extending, in said transverse direction, over a transversally central section of said transverse beam unit; and said substantially C-shaped cross section, in particular, extending, in said transverse direction, over a transverse dimension, said transverse dimension being at least 50% of a transverse distance between longitudinal center lines of said longitudinal beams in the area of said transverse beam unit.

* * * * *